United States Patent [19]

Boyce

[11] Patent Number: 4,688,566

[45] Date of Patent: Aug. 25, 1987

[54] FILTER MASK

[75] Inventor: Elvin L. Boyce, Salt Lake City, Utah

[73] Assignee: Professional Tape Converters, Inc., Salt Lake City, Utah

[21] Appl. No.: 856,600

[22] Filed: Apr. 25, 1986

[51] Int. Cl.[4] ..... A62B 7/00

[52] U.S. Cl. ..... 128/206.19

[58] Field of Search ..... 128/206.19, 139, 201.17

[56] References Cited

U.S. PATENT DOCUMENTS

| | | | |
|---|---|---|---|
| Re. 24,549 | 10/1958 | Haliczer | 128/206.19 |
| 2,752,916 | 7/1956 | Haliczer | 128/139 |
| 3,038,470 | 6/1962 | Campbell | 128/206.19 |
| 3,603,315 | 9/1971 | Becker | 128/146.2 |
| 3,884,227 | 5/1975 | Lutz et al. | 128/146.2 |
| 3,971,369 | 7/1976 | Aspelin et al. | 128/146.2 |
| 3,985,132 | 10/1976 | Boyce et al. | 128/146.2 |
| 4,248,220 | 2/1981 | White | 128/206.19 |
| 4,300,549 | 11/1981 | Parker | 128/206.19 |
| 4,419,993 | 12/1983 | Petersen | 128/206.19 |
| 4,606,341 | 8/1986 | Hubbard et al. | 128/206.19 |

FOREIGN PATENT DOCUMENTS

| | | | |
|---|---|---|---|
| 2233029 | 1/1975 | France | 128/206.19 |
| 7706660 | 12/1977 | Netherlands | 128/206.19 |
| 5104 | of 1913 | United Kingdom | 128/206.19 |
| 2045093 | 10/1980 | United Kingdom | 128/206.19 |
| 2103491 | 2/1983 | United Kingdom | 128/206.19 |

OTHER PUBLICATIONS

Douglas W. Cooper et al., "Common Materials for Emergency Respiratory Protection: Leakage Tests with a Manikin", Am. Ind. Hyg. Assoc. J., vol. 44 (10), pp. 720 to 726 (Oct. 1983).

K. B. Rogers, "An Investigation Into the Efficiency of Disposable Face Masks", J. Clin. Pathol., vol. 33, pp. 1086 to 1091 (received for publication Mar. 18, 1980).

*Primary Examiner*—Henry J. Recla

*Attorney, Agent, or Firm*—Workman, Nydegger & Jensen

[57] ABSTRACT

A filter mask for filtering air inhaled and exhaled from the mouth and nostrils while providing a positive facial lock at all edges of the mask. In a preferred embodiment of the invention both the upper and lower edges of the mask are provided with moldable stiffeners for conforming to the shape of the wearer's nose and cheek area and the lower jaw and chin area, respectively. The lower edge is folded so as to form a reverse pleat which conforms to the shape of the lower jaw. A single headband may be used to hold the mask on the head. The peripheral edges of the mask are bound. The mask provides excellent filtration since the positive facial lock around all edges of the mask substantially prevents air from leaking between the mask and the face.

46 Claims, 12 Drawing Figures

FILTER MASK

BACKGROUND

1. The Field of the Invention

This invention relates to filter masks which isolate both the mouth and nostrils of a wearer from the surrounding environment. More particularly, the invention relates to a filter mask which provides a positive facial lock while requiring only a single headband to secure the filter mask to the wearer's head.

2. The Prior Art

There are many situations today where it is necessary to filter the air which is inhaled and exhaled. Such filtration is primarily concerned with removal of small particulate matter, such as dirt or bacteria, as opposed to gases or liquids, from the air. Perhaps the most common instance in which a filter mask is used is in the medical arts. However, the same filter masks which have application in the medical arts are also, in many cases, well suited for use in industrial and domestic applications as well.

In the medical arts, filter masks are often used to prevent nasopharyngeal organisms and materials which are exhaled by the wearer from entering the surrounding environment. The same mask may also be used to protect the wearer from inhaling harmful microorganisms. In both applications, it is important that the filter mask be fabricated from a material which exhibits a high bacterial filtration efficiency (BFE) and also have a structure that prevents the migration of microorganisms across the filter medium. One of the more common applications of filter masks in the medical arts is the wearing of masks by a surgical team while performing surgical procedures. A mask worn during surgical procedures, for example, must provide proper BFE while still being comfortable for the wearer who may be wearing the same mask for several hours.

In the industrial arts it is often necessary for individuals working in "clean room" environments to avoid the introduction of any particulate matter, including microorganisms which may be exhaled by the wearer, into the clean room environment. Some clean room environments may be significantly more "clean" (i.e., particle free) than the required level of cleanliness in some surgical operating room environments. Such clean rooms are required when fabricating what are termed very large scale integrated circuits (VLSIC) which are at the heart of modern electronic computers. As in the medical arts applications, industrial applications may require the workers to wear their filter masks for extended periods of time. Therefore, considerations of comfort and durability are of prime importance.

Other industrial applications require the filtration of the air which is inhaled by the wearer. Often construction or agricultural workers will be working in a "dirty" environment in which the air would be harmful to breathe if it were not filtered. Many times filter masks are used in such circumstances to protect the wearer from harm.

Besides the medical and industrial applications there are domestic applications for such masks in the home. Many hobbyists have uses for an efficient and comfortable filter mask. For example, an individual applying paint by means of a spray gun desires to ensure that the airborne droplets of paint are not inhaled. While filter masks may have application in a wide variety of fields, as exemplified in the prior discussion, it can be seen that the design requirements of filter masks to be used in these different applications share many common design criteria such as proper filtration, comfort, and durability.

Regardless of the application, there are several considerations which must be raised when designing a filter mask to be worn by a human. First, the material used as the filter material must have the characteristic of preventing the passage of the size of particles which are desired to be filtered. The size of particles may vary between 10 micro-millimeters or smaller in the case of a bacterium, to a millimeter or more in the case of particles of dirt and dust. Furthermore, while still maintaining proper filtration efficiency, the filter material must allow for the passage of air without undue resistance. Also, the full benefits of the filter mask will not be realized if inhaled or exhaled air is allowed to leak around the edges of the filter material where the mask is not held securely against the wearer's face. Thus, if a positive facial lock is not maintained, the purpose of the mask may be defeated and the mask could be of little use.

Furthermore, the mask must be economical since most users of filter masks dispose of the mask after a single use. Still further, some applications may require that masks be changed regularly, for example every few hours when the wearer is working at an extremely dusty construction site. This consideration requires that both the materials used to construct the mask, and the method used to fabricate the mask, be such that costs are kept low. Furthermore, it is generally very desirable to design a mask which may be stored in a very small space. Generally, a flat storage configuration provides for the most compact storage.

Of immediate concern to the wearer of the mask is the comfort of the mask while it is on the wearer's face. Generally, the mask will be most comfortable if contact with the mouth is avoided. If the filter material contacts the wearer's mouth, the comfort, and often the integrity, of the mask is generally reduced. Furthermore, as various liquids from the wearer's face collect, such as perspiration and saliva, the portions of the mask held against the face may become saturated with liquid, thus reducing the comfort of the mask as well as presenting the potential risk of transferring microorganisms from one side of the filter material to the other. Still further, a filter mask should be relatively quick and easy to install, that is to place on the face, and should remain in the proper position while the wearer continues his ordinary activities.

In the prior art, many attempts have been made to achieve some or all of these desirable characteristics in a filter mask, but a mask fulfilling all of these requirements has hitherto not been available in the art. For example, U.S. Pat. No. 3,971,369, issued to Aspelin et al., discloses a surgical face mask in which the filter material is folded so as to form a cup shape to prevent the filter material from resting against the face of the wearer. Still further, U.S. Pat. No. 4,300,549, issued to Boyce et al., discloses a filter mask which is provided with both pleats in the filter material and conformable stiffening members which are embedded within the filter material so that the filter material is held away from the wearer's face. U.S. Pat. No. 2,752,916, issued to Haliczer, discloses a face mask which is held on the head by the use of a single headband which increases the ease with which the mask is placed on the wearer's face. However, none of the masks disclosed in these cited patents addresses the problem of excessive "leaking" of air around the edges of the filter material, a common problem with nearly all masks available in the prior art.

In view of the leaking problems encountered with the filter masks available in the prior art, it would be a significant advancement in the art of filter masks to provide a flexible filter mask which provides a positive facial lock by providing a secure seal around the edges of the mask against the face of the wearer. It would be a further advancement in the art to provide a filter mask which can be easily placed on the wearer's head by providing a single elastic band, or tie, for holding the mask on the face.

It would also be an advancement in the art to provide a mask which allows the wearer a greater degree of comfort than has hitherto been available by providing that the mask does not collapse on the wearer's face. Furthermore, it would be an advantage to provide a filter mask which does not shed fibers or particulates, since such shedding would tend to defeat the purpose of using masks in environments such as industrial clean rooms. It would also be an advance in the art to provide a filter mask which provides the above-listed advantages while properly fitting on a broad range of facial types and head sizes.

Still further, because of a cumbersome double tie arrangement often used, the masks in the prior art may require a significant amount of space for storage. Also, the cumulative weight of such masks may be substantial. Thus, the availability of a mask which may be more compactly stored, and which weighs less than those masks available in the prior art would be a further improvement to the art. Furthermore, many masks available in the prior art cause fogging of eyeglasses worn by the wearer due to the escape of vapor-laden exhaled breath between the upper edge of the multiple layers of filter material and between the mask and the wearer's nose and cheeks. Providing a mask which prevents the fogging of eyeglasses due to escaping exhaled vapor would also be a useful advance in the art. These and other considerations are addressed and solved by the invention herein described.

BRIEF SUMMARY AND OBJECTS OF THE INVENTION

The present invention is directed to filter masks which can be used in a wide variety of medical, industrial, and domestic applications. The filter mask may be fabricated from materials which allow it to be disposed of after a single use or to be reused any number of times. The filter mask effectively seals the nostrils and the mouth of the wearer from the surrounding environment.

In one preferred embodiment of the present invention, the filter mask is constructed from a rectangular sheet of flexible filtering material, which filtering material is, for example, of the multilayer type. Molable stiffeners, of a material such as aluminum, are encapsulated in proximity to each of two parallel edges of the filter material. One of the edges having an encapsulated moldable stiffener is folded into a reverse pleat. The reverse pleat is formed by folding one of the edges of the filter material having a moldable stiffener such that a substantial portion of the filter material is folded back on itself and so that a portion of the inner surface of the filter material is folded upon itself.

Various pleats may also be formed within the body of the filter medium between the edges containing the encapsulated moldable stiffeners. The purpose of these pleats is generally to provide that when the filter mask is installed upon the wearer's face, the pleats may be unfolded into a cup-like shape to hold the filter material away from the wearer's mouth. Such pleats may take the form of a duckbill pleat, a staggered pleat, an omega pleat, or any number of suitable pleating arrangements. Once the pleats have been formed in the filter material, the remaining edges of the filter material are bound such that the pleats, including the reverse pleat, are permanently formed.

As the mask is installed on the wearer's face, the reverse pleat is unfolded to create a pocket-like recess which is placed under the wearer's lower jaw and chin so as to accommodate the same. The lower moldable stiffener is conformed to the shape of the wearer's lower jaw and chin and the upper conforming stiffener is conformed to the shape of the wearer's nose and cheeks. The engagement provided by the reverse pleat against the wearer's chain secures the bottom of the mask and provides that a single tie or elastic headband may be used to hold the top portion of the mask in the proper position on the face.

Because of the action of the reverse pleat, the moldable stiffeners, and the bound edges of the filter material, a positive facial lock around all the edges of the mask is provided with only the need for a single tie or elastic headband. Furthermore, the pleating arrangement of the filter material serves to hold the filter material away from the mouth which greatly increases the comfort of the filter mask. Additionally, if desired, stiffeners may be added within the body of the filter material to ensure that the mask does not collapse as the wearer breaths and as it is subjected to the rigors of the environment. Still further, various additional features may be added to the mask so as to particularly adapt it for use in various medical, industrial, or domestic applications.

In view of the foregoing, it is a principal object of the present invention to provide a filter mask which effectively filters either inhaled or exhaled air from the nostrils or the mouth of the wearer.

It is a further object of the present invention to provide a filter mask which maintains a positive facial lock thus preventing leakage of material around the edges of the mask.

Another object of the present invention is to provide a mask which exhibits a high bacterial filtration efficiency while still maintaining the comfort of the wearer.

A still further object of the present invention is to provide a mask which resists collapsing on the mouth of the wearer thus causing discomfort.

Another important object of the present invention is to provide a filter mask which does not shed fibers or other bits of particulate matter.

Still another object of the present invention is to provide a filter mask which will fit a broad range of facial types and sizes.

Yet another object of the present invention is to provide a filter mask which does not allow exhaled vapors or particulates to escape through the edges of the mask.

Yet another object of the present invention is to provide a filter mask which is light weight and which may be stored in a compact configuration.

These and other objects of the present invention will become readily apparent from the following description taken in connection with the accompanying drawings.

DETAILED DESCRIPTION OF THE PREFERRED EMBODIMENTS

Figure 1:
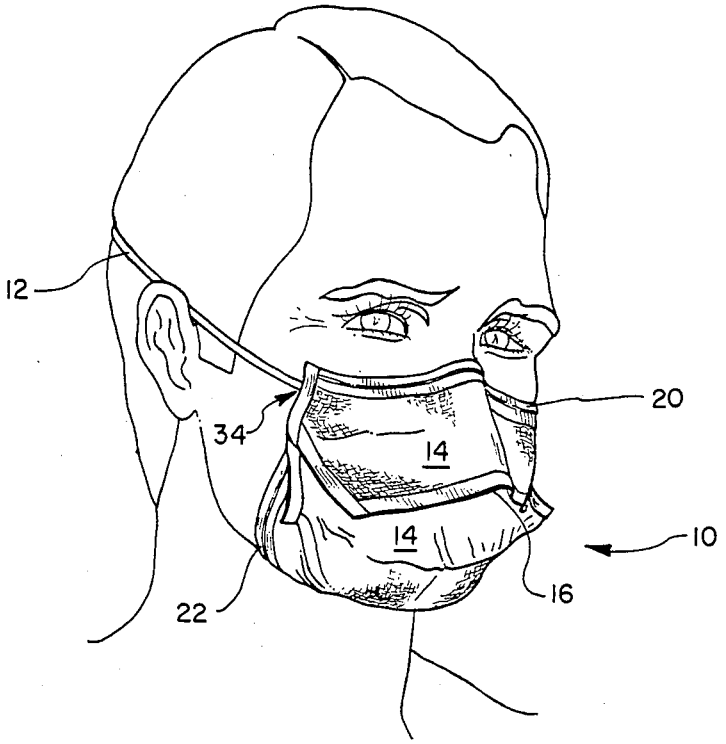
FIG. 1 is a perspective view of one presently preferred embodiment of the present invention installed upon the wearer's face.

Reference will now be made to the drawings wherein in like structures will be designated with like numerals throughout. FIG. 1 is a perspective view of one presently preferred embodiment of the present invention, generally designated 10, installed upon the face and head of the wearer. The filter mask of the present invention may have application in medical, industrial, domestic, or other circumstances.

The filter mask 10 is generally configured so as to provide a positive facial lock which prevents passage of any material between the nostrils and mouth and the surrounding environment except through the filter material. The makeup of the filter material, and the pleating used in connection with the mask, in particular the reverse pleat, will be explained in detail shortly. The mask has the particular advantage of allowing a positive facial lock to be created and maintained upon installation of the mask on the face while only a single tie or elastic band, designated 12 in FIG. 1, is used.

The various embodiments of the filter mask of the present invention may be constructed of a wide variety of materials. Perhaps the first consideration to be addressed when selecting an appropriate material is whether or not it is desirable to fabricate a mask which is disposable. The term disposable generally means that the cost of the mask is such that it may be disposed of after only a single use. Generally, the vast majority of filter mask used in surgical and industrial applications are of the disposable type. Thus, while it should be appreciated that materials which are intended to be reused a number of times can be adapted for use with the present invention, the embodiments set forth herein will be described using only disposable materials.

While it may initially appear that disposing a mask after a single use increases the cost per use, such is often not the case. When the cost of preparing a reusable mask (e.g., sterilizing the mask) for reuse is considered, it is often less expensive to use a disposable mask. Furthermore, the art of preparing materials which are to be used as filter materials for disposable masks has advanced to the point where such materials are as efficient, or more efficient, than the previously available non-disposable materials. An example of such non-disposable materials are the linen materials that have been used in the past for filter masks. Furthermore, it must be appreciated that even though the embodiments described herein are termed disposable, they may, in some applications, be reused many times without substantial loss of efficiency. Another advantage of the present invention is that the mask may generally be reused even if it is crushed or bent. For example, a construction worker might fold the mask and place it in his pocket for later use. Because of the features of the mask as described herein, the mask would generally still be usable.

The filter material, designated 14 in the figures, used to fabricate the embodiments in FIGS. 1–10 may vary according to the particular application of filter mask 10. For example, when mask 10 is to be used in a medical application, such as on members of a surgical team, it is common to use a three layer filter material. However, appropriate filter materials may be of a single or multiple layer design. Multi-layer material may be readily purchased in a precollated form, that is with the three layers already arranged, or the materials may be obtained separately and the filter material formed as part of the process for forming the mask.

Generally, a three layer filter medium might include an outer layer of a relatively porous paper-like material which provides durability and resistance against abrasion. The outer layer may also be generally stiffer than the other layers. By using a stiffer outer layer the effectiveness of the various pleating arrangements is increased. The pleating arrangements may be incorporated in the body of the filter material to hold the mask in a cup-like shape when installed. The middle layer of the filter material generally consists of polyethylene or polypropolyene, or other material, which exhibits the proper filtration characteristics. Glass fiber based materials may also have applications as the middle filtration layer. The innermost layer to be worn next to the face is generally comprised of a soft material for providing a soft, non-irritating surface against which the facial skin will make contact.

In medical applications, it is generally important that the filter material also provide a high bacterial filtration efficiency (BFE). The BFE of a filter material is generally arrived at by determining the percentage of bacteria, such as *Staphylococcus aureus* or *Bacillus stearothermophilus,* that is able to migrate through the filter material under normal conditions. The fewer bacteria which are able to pass through the filter material, the higher the BFE. Of course, a BFE of 100% is desirable, however, efficiencies of as low as 25% are not uncommon among some types of prior art disposable filter masks. However, materials are available which provide BFE's of between 90 and 99%. Thus, in a medical environment it is generally desirable to utilize a filter material having as high a BFE as possible so as to prevent release of nasopharyngeal organisms into the environment.

In general, the considerations that provide for a high BFE are the same considerations which provide that a filter material would be desirable in applications in industry and domestic use. For example, a filter material which inhibits the migration of nearly all bacteria, would generally also prevent inhalation of dust and dirt particles in industrial applications. Furthermore, it has generally been found that those materials providing a high BFE are often also those materials which provide the least resistance to passage of gases through the filter material. The passage of gases through the filter material is of great importance in maintaining the comfort of the wearer, a consideration to be discussed shortly. It should be realized, however, that many applications might require greater or lesser standards of filtration than is commonly required in the medical environment.

Thus, while filter materials having an efficiency suitable for use with the present invention are available in the art, the best filter material is of little use if the air inhaled and exhaled by the wearer is allowed to escape around the edges of the mask without passing through the filter material. Indeed, the lack of a positive facial lock in the masks available in the prior art is of critical concern to those involved in the design and fabrication of filter masks. Thus, the present invention, while using materials generally available as a filter material, provides a unique positive facial lock which prevents inhaled and exhaled air from escaping around the edges of the mask. The maintenance of such a positive facial lock greatly improves the overall efficiency of the filter mask.

The structures used in the present invention to provide a positive facial lock upon installation will now be described. As mentioned earlier, the present invention may incorporate a variety of various pleating arrangements. One presently preferred embodiment of the present invention, illustration in FIG. 1, incorporates what is commonly termed a duckbill pleat, the apex of the pleat being indicated at 16.

Figure 1A:
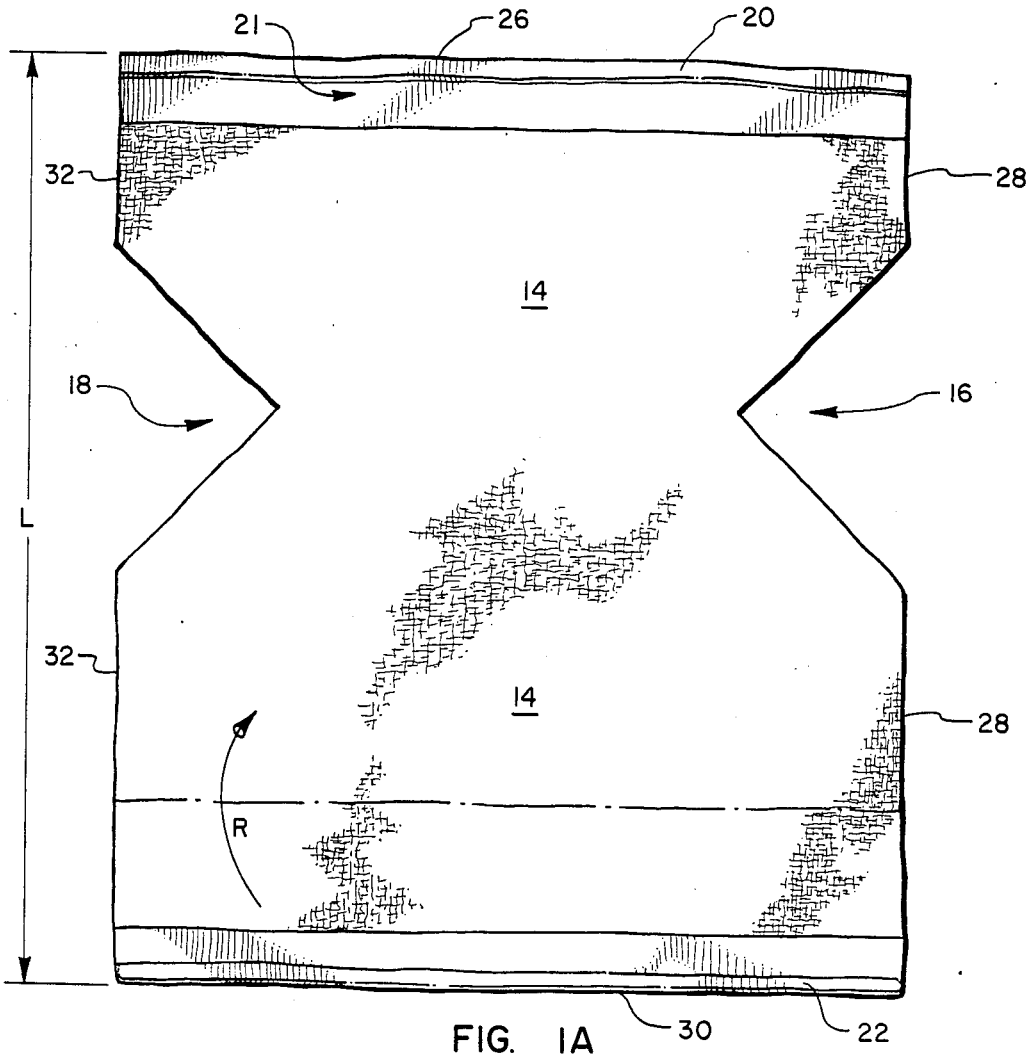
FIG. 1A is a plan view showing the approximate location of some of the structures of the embodiment illustrated in FIG. 1 during an intermediate fabrication step.

The structure of the embodiment illustrated in FIG. 1 may be best explained by discussing a representation of some the major steps in the fabrication of mask 10. Referring to FIG. 1A, the filter material 14, which is chosen giving due concern to the considerations listed above, is generally prepared as a rectangular piece of flat filter material as shown in FIG. 1A. The filter material 14 shown in FIG. 1A generally has two notches, generally indicated at 16 and 18, along two parallel edges, 28 and 32, respectively, in order to facilitate the formation of the duckbill pleat.

Moldable stiffeners are secured to the upper and lower portions of the filter material as shown at 20 and 22, respectively, in FIGS. 1 and 1A. It should be understood that the use of the term "moldable stiffner" herein is meant to include the use of both moldable and flexible stiffners. It is preferred that moldable stiffners 20 and 22 may be placed directly next to their respective edges. Alternatively, moldable stiffners 20 and 22 may be placed somewhere along the top portion or bottom portion of filter material 14. The important property of moldable stiffeners 20 and 22 is that the material be pliant enough to be bent to a shape that conforms to the face of the wearer, and then retain that shape. In this regard, it is important that moldable stiffeners 20 and 22 not be too stiff so as to make it difficult for the wearer to conform the mask upon installation.

Generally, as used herein, the upper or top portion of the mask will refer to that portion which contacts the nose and cheeck areas while the lower, or bottom, portion of the mask will be that portion which is in proximity to the lower jaw and chin. In one preferred embodiment, moldable stiffeners 20 and 22 comprise aluminum strips about 0.5 millimeters thick and about 3 millimeters wide. However, the masks of the present invention may be constructed using a binding material which exhibits stiffening characteristics rather than using separate moldable stiffners 20 and 22.

While several different methods of attaching the moldable stiffeners 20 and 22 to filter material 14 are available, one presently preferred method is that of encapsulating the stiffeners within heat activated tape which becomes adhesive when it is heated. Such heat activated tape is well known in the art and is commercially available. Encapsulating the moldable stiffeners within a binding of heat activating tape provides a convenient structure for holding the moldable stiffners 20 and 22 in place.

The use of heat activated tape is presently preferred for any attaching function required during the fabrication of the present invention. In this regard, methods available for attaching filter material 14 to other materials, or to itself, include sewing, gluing, ultrasonic bonding, or heat activated tape. While all of these methods can be used with the present invention, heat activated tape is presently the preferred method of attaching structures of the present invention. Each of the other three methods may be less advantageous for one reason or another.

For example, ultrasonic bonding often requires the use of expensive and complicated equipment and also requires that extreme care be taken to avoid metallic objects, such as moldable aluminum stiffeners 20 and 22, during the bonding process. Gluing, while providing a secure attachment, presents the difficulty of allowing particles of glue to become dislodged into the environment at well as sometimes creating a "lump" of glue which may cause discomfort to the wearer as well as being inflexible.

Sewing is the most common method of fabricating a filter mask. However, sewing also has potential drawbacks. First, sewing creates perforations in the filter material 14 which allow additional unfiltered air to pass from the inner surface of the filter mask to the outer surface and into the environment. Ultrasonic bonding may also create such perforations in filter material 14. Further, sewing filter materials 14 creates the potential that fibers from both the filter material and the thread will be released into the environment as the mask is worn. While such minute fibers are of little concern in a medical environment, in an industrial clean room such fiber are extremely undesirable. Furthermore, once the mask is installed, the threads used in the sewing process, which are typically "harder" than filter material 14, will abrade the filter material 14 causing additional fibers to be released into the environment as the mask is worn.

Despite its disadvantages, sewing does provide the greatest strength of all of the methods. Thus, when sewing is used with the present invention, it is preferable that the seam afterwards be covered with heat activated tape to avoid release of fibers into the environment. Finally, the use of heat activated tape generally avoids the difficulties inherent in the other attachment methods. Thus, any edges of the filter material, rather than being left unfinished, are preferably bound by heat activated tape. In the illustrated embodiments all of the edges are bound by heat activated tape.

A further difficulty that is avoided by binding all edges of filter material 14 by using heat activated tape is that escape of microorganisms and water vapor through the spaces between the layers of a multilayer filter material is prevented. Many types of three layer filter materials are constructed so that each layer of the filter material is not completely bonded to the adjacent layers. Thus, interlayer spaces may be created which, if not sealed by binding the edges, may allow migration of microorganisms from the interior of the mask through the inner layer, and to the outside edges of the mask into the environment.

Furthermore, individuals who wear eyeglasses also are plagued by the problem of fogging of their glasses due to condensation of warm, vapor laden exhaled air on the colder surface of their eyeglasses. Ensuring a positive facial lock along the upper edge of the mask helps to reduce fogging of eyeglasses due to the condensation of vapor laden air can be reduced. Still further, in many mask designs vapor laden air is allowed to pass through the upper portion of filter material 14 and condense on the wearer's eyeglasses. By applying heat activated tape along upper edge 26 a vapor barrier is created. This occurs because applied heat activated tape is relatively impervious to gases compared to filler material 14. Thus, heat activated tape may be preferably applied to the uppermost one-half inch of filter material. Use of heat activated tape in this fashion, as generally indicated in FIG. 1A at 21, provides both a convenient method of attaching moldable stiffners 20 and 22 to filter material 14 and also a vapor barrier to minimize fogging of eyeglasses. It should be understood that other structures and materials can be used to form a vapor barrier.

Figure 1B:
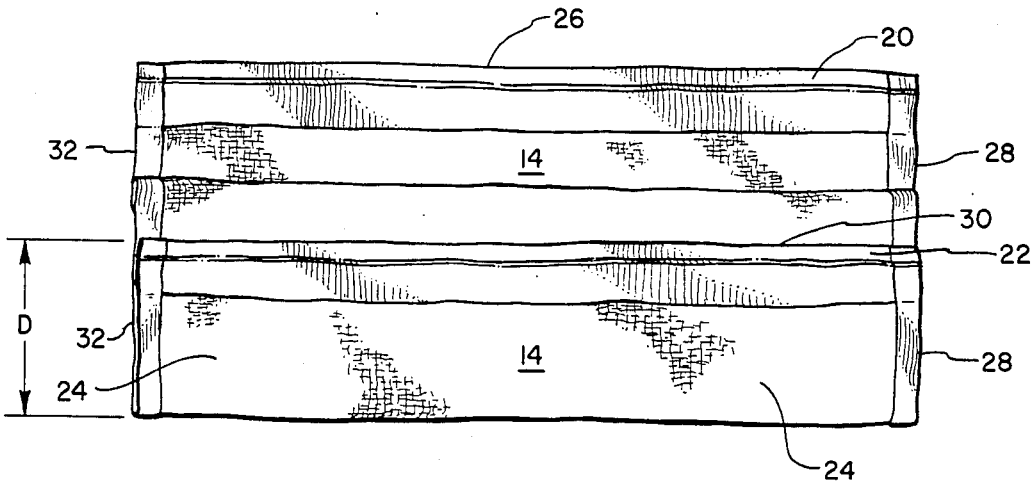
FIG. 1B is a plan view showing the structures of FIG. 1A in a subsequent fabrication step.

Of prime importance to the present invention is the formation of what is termed a reverse pleat. As used herein, the term "pleat" refers to a relatively flat double-fold formed in filter material 14 when the mask is in the flat storage configuration. As will be explained shortly, the reverse pleat serves the important function of forming a pocket-like recess for holding the mask on the lower jaw and around the chin area. As indicated by the arrow marked "R" in FIG. 1A, the reverse pleat, designated 24 in FIG. 1B, is created by folding approximately one inch of the bottom portion of filter material 14. Generally, the bottom, or lower, portion of filter material is that area from approximately the mid-point of filter material (the location of notches 16 and 18 in FIG. 1A) to lower edge 30. Similarly, the top, or upper, portion generally refers to that area from approximately the mid-point to upper edge 26.

Both FIGS. 1A and 1B are plan views of filter material 14 taken from the direction of the inner surface of the filter mask 10. Filter material 14 is folded such that the inner surface of the material is folded against itself. The "depth" of reverse pleat 24, indicated by the line marked "D" in FIG. 1B, is determined by the amount of filter material that is folded back on itself, which may be in the range of from about ½ inch to about 1½ inches. However, a depth of about 1 inch has been determined to be the presently preferable depth D of reverse pleat 24 when the mask is to be used on an average size adult.

As shown best in FIG. 1B, the reverse pleat is formed by folding the bottom edge 30 toward the inner surface of filter material 14 such that the side edges 28 and 32 are folded back upon themselves at the lowermost portion thereof, and are then secured by heat activated tape along the depth D. By this means, a single reverse pleat is formed on the lower half of the mask, the top and bottom edges 26 and 30 remaining essentially paralled and the reverse pleat preferrably comprising only approximately the lower third of the mask.

However, it may be desirable to increase the depth of reverse pleat 24 to greater than 1½ inches for masks which are intended to be worn by individuals having smaller faces. In this regard, in order to economically fabricate the filter mask of the present invention, it is most advantageous that the filter material be "cut" to one length for all pleating arrangements (e.g., duckbill, staggered, etc.), such as designated in FIG. 1A by line L, regardless of the ultimate size of the mask. Thus, by increasing the depth D of reverse pleat 24, it is possible to create a mask which may be efficiently worn on a smaller face without requiring that filter material 14 be cut to a different length.

The fold for reverse pleat 24 may be formed previously, simultaneously, or subsequently to forming the additional pleats in the filter material. After the pleats are formed edges 26, 28, 30, and 32 of filter material 14 are bound as shown in FIG. 1B. As explained earlier, the edges of the masks are preferably bound with heat activated tape. With the pleats, such as duckbill pleat (shown best at 16 in FIG. 4) and reverse pleat 24, formed as described in connection with FIGS. 1A and 1B, the filter mask, after installation on the face, takes on the configuration shown in the cross-sectional view of FIG. 2. As can be seen from FIG. 2, the upper moldable stiffener 20 provides that the filter material is held against the nose and cheeks while the lower moldable stiffener 22 provides a secure seal in the jaw and chin area.

Figure 2:
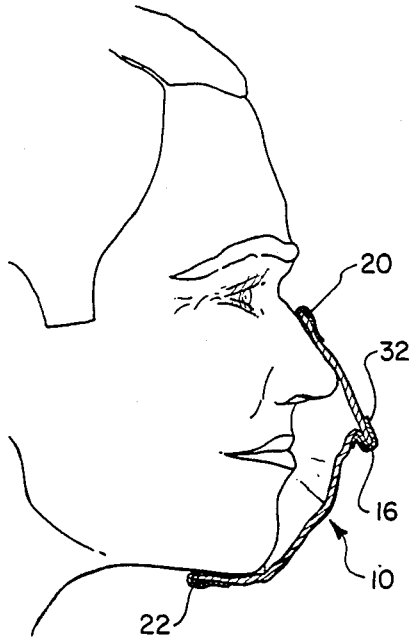
FIG. 2 is a cross-sectional view of the embodiment shown in FIG. 1.
Figure 3:
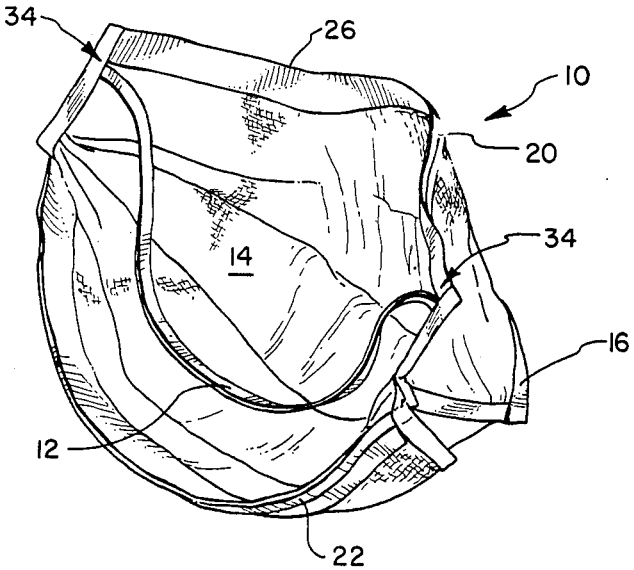
FIG. 3 is a perspective view of the embodiment shown in FIG. 1 taken from a reverse angle.

The configuration taken on by the embodiment shown in FIGS. 1 and 2 when installed, can also be seen in the reverse angle perspective view of FIG. 3. In FIG. 3, the conforming function of the upper moldable stiffener 20 against the nose and cheek area can be readily seen. Furthermore, it can also be seen that reverse pleat 24 allows the creation of a pocket-like shape by which the inner surface of the filter material is held tightly against the lower jaw area of the wearer. The lower moldable stiffener 22 increases the facial lock formed around the jaw.

Because of the use of reverse pleat 24, and the upper and lower moldable stiffeners 20 and 22, a single elastic headband 12 may be used in connection with the present invention. As shown in FIGS. 1 and 3, headband 12 preferably should be attached to filter material 14 near the upper corners of the mask as indicated by arrows 34. Also, headband 12 should be positioned such that a slight upward pull on the filter mask occurs thus helping maintain the positive facial lock around the jaw area. This upward force may be accomplished by placing elastic headband 12 over the ears as shown in FIG. 1.

In the present invention, an elastic headband 12 is the presently preferred method of securing face mask 10 in the proper position on the face. Use of elastic headband 12 allows the mask to be easily installed by the wearer and avoids the difficulty of tying a string tie behind the head. Furthermore, since headband 12 is elastic, there is not the risk of the headband becoming untied at an inopportune moment which accompanies the use of ordinary tie strings. Furthermore, the elasticity of the headband material may be chosen so as to allow mask 10 to be easily repositioned on the face while only using one hand.

The characteristics of elastic headband 12 which are of concern to the present invention are its length, width, and extensibility. The length of elastic headband 12 must be chosen so as to provide enough force to properly hold the mask on the face of the smallest wearer contemplated. However, elastic band 12 must be long enough so that excessive pressure is not exerted upon the head of the wearer. The comfort of filter mask 10 can be greatly increased by choosing headband 12 of proper width. If headband 12 is of proper width, the force against the wearer's head will be distributed over a greater surface area than if a narrower headband 12 were used. Also, since the length of headband 12 may be limited due to practical considerations, the extensibility of headband 12 may be altered to fit the particular circumstances. Thus, the comfort of the wearer may be greatly increased by using a headband of proper length, width, and extensibility. Many materials which are available in the art are suitable for use as elastic headband 12.

By properly positioning headband 12 and reverse pleat 24 upon installation of mask 10, a positive facial lock is provided not only along the upper and lower moldable stiffeners 20 and 22, as shown in FIG. 1, but also along the vertical edges of the mask which contact the cheeks, due to the effect of the tension exerted because of the cooperation of reverse pleat 24 and headband 12. Furthermore, the filter masks of the present invention still allow for normal speech without significant difficulty while maintaining a positive facial lock.

Figure 4:
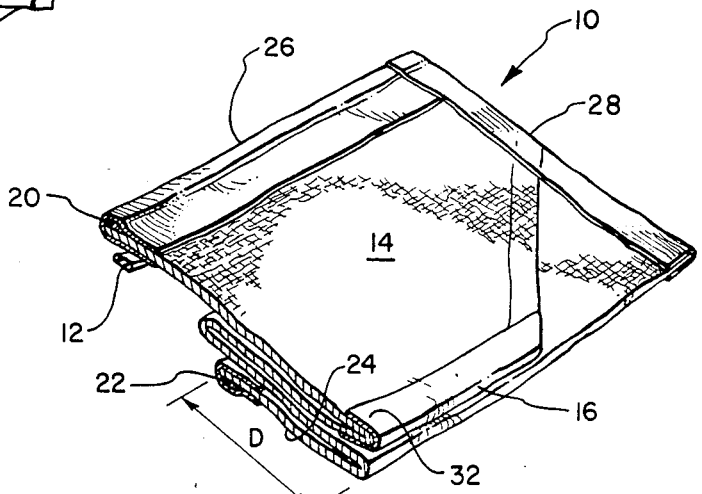
FIG. 4 is a cross-sectional view of the embodiment shown in FIG. 1 in a storage configuration.

The construction of the embodiment incorporating a duckbill pleat can also be seen in the cross-sectional view of FIG. 4. The reverse pleat is shown at 24, while the edges of the duckbill pleat are indicated at 16. The upper moldable stiffener, which is encapsulated in heat activated tape, is shown at 20. The lower moldable stiffener, similarly encapsulated, is shown at 22. The elastic headband is shown in cross-section at 12.

A further feature of the embodiment incorporating the duckbill pleat 16 is the application of a length of heat activated tape 32 along the outer edge of the duckbill pleat 16 as shown best in the cross-sectional views of FIGS. 2 and 4. Heat activated tape 32 applied in this manner serves as an additional stiffening member to assist in preventing the collapse of the filter material 14 upon the mouth of the wearer as the wearer inhales.

Generally, it is very desirable to form mask 10 so that filter material 14 is held away from the mouth. This allows for the greater comfort of the wearer as well as assisting in the prevention of the mask deterioration due to excessive flexing of the filter material and due to absorption of excessive amounts of moisture from the mouth area. While additional heat activated tape 32 is used as a stiffening member for the duckbill embodiment illustrated in FIGS. 1–4, other stiffening members (not shown) may be used with all of the embodiments disclosed herein. For example, small aluminum or plastic stiffening members may be adhered to or embedded within, the filter material. The important function that must be performed by any stiffening member that is used in this manner is to keep the filter material 14 separated from the mouth so as to create an airspace between the mouth and the inner surface of the filter material.

Figure 5:
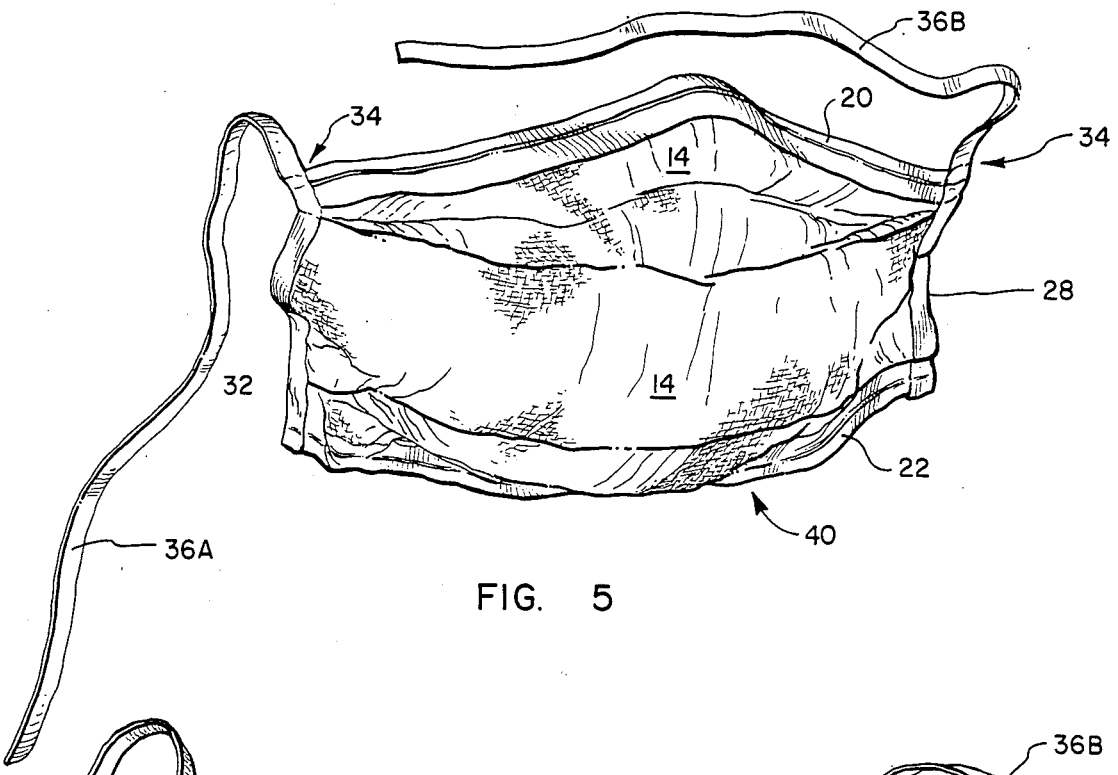
FIG. 5 is a perspective view of another presently preferred embodiment of the present invention in a configuration ready for installation on the face.
Figure 6:
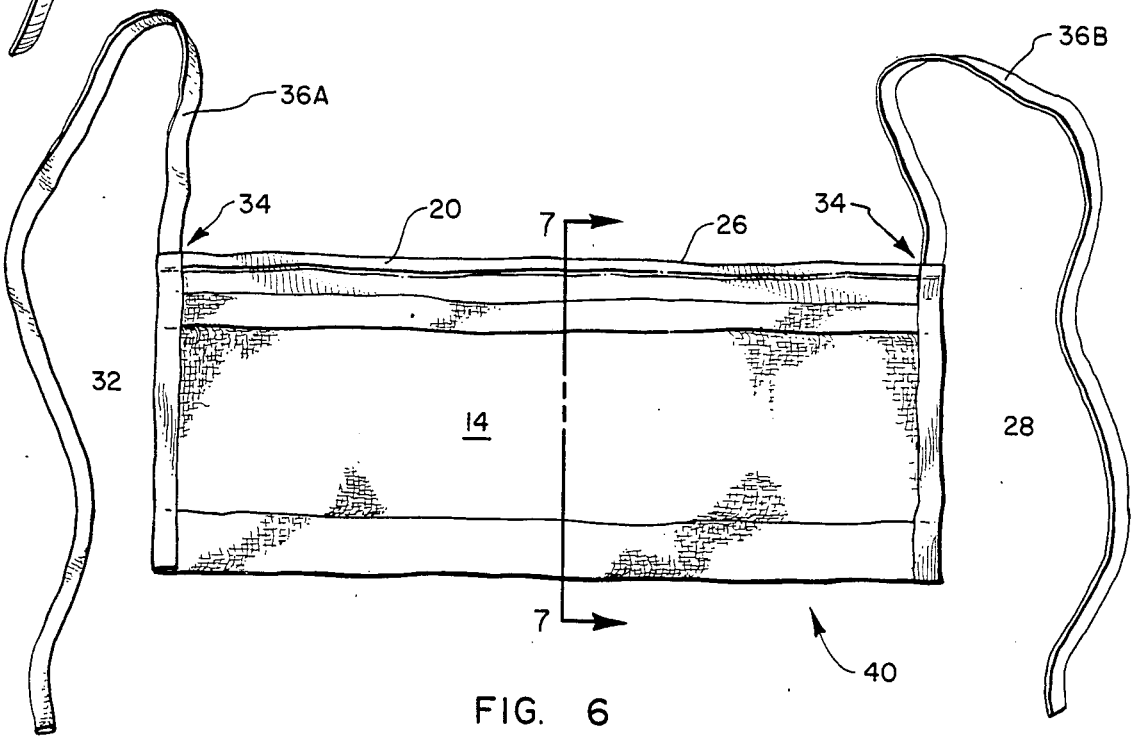
FIG. 6 is an elevated view showing the embodiment illustrated in FIG. 5 in a storage configuration taken from a direction facing toward the outer surface of the embodiment.
Figure 7:
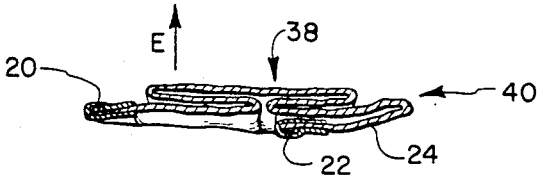
FIG. 7 is a cross-sectional view of the embodiment shown in FIG. 6 taken along line 7—7.

Another embodiment of the present invention is illustrated in the perspective view of FIG. 5 and is generally indicated at 40. The embodiment shown in FIGS. 5–7 is similar in its essential characteristics to the embodiment illustrated in FIG. 1. That is, mask 40 includes reverse pleat 24, shown best in FIG. 7, upper and lower encapsulated moldable stiffeners, as shown best in FIG. 7 at 20 and 22 respectively, and edges 26, 28 and 30 bound with heat activated tape. However, single elastic headband 12 shown in FIG. 1 has been replaced with a single string tie, 36A and 36B, attached to upper corners 34 of mask 40. This single string tie arrangement is provided for those who prefer that mask 40 be equipped with string ties. Either elastic headband 12 or the string ties, 36A and 36B, may be used with any of the embodiments shown herein.

FIG. 5 shows the embodiment in a configuration ready to be installed upon the face. FIG. 6 illustrates the embodiment of FIG. 5, from an elevated view facing the outer surface of filter material 14, in the storage configuration. The embodiment illustrated in FIGS. 5–7, differs from the embodiment shown in FIGS. 1–4 in that it incorporates what is termed an omega pleat, generally designated 38 in FIG. 7, rather than a duckbill pleat 16, into filter material 14. The configuration of the omega pleating can be seen best in the cross-sectional view of FIG. 7.

In FIG. 7, upper and lower moldable stiffeners 20 and 22 can be seen in cross-section as well as reverse pleat 24. The omega pleat 38 is so named because when the pleat is partially expanded, in the direction of the arrow marked E in FIG. 7, the cross-section forms a shape roughly equivalent to the greek letter omega.

As with the other embodiments of the present invention, the principal purpose of the pleating arrangement, other than reverse pleat 24, serves to provide a Cup-like cavity between the mouth and the inner surface of filter material 14. As mentioned previously, additional stiffening members can be added to filter material 14 so as to prevent collapse of filter material 14 upon the mouth while inhaling.

While single string ties, 36A and 36B, may be used with all the embodiments of the present invention, such a tie arrangement requires significantly more space for the embodiment to be stored. In fact, the use of the single elastic headband 12 allows the same number of filter masks to be stored in one third of the space that is required when conventional filter masks are equipped with double string ties (not shown in the drawings). The savings in storage space, due to the high volume of masks used in many applications, can be significant. Furthermore, the use of elastic headband 12 rather than double or single string ties, also reduces the weight of each filter mask of the present invention. Such a reduction in weight, while generally not affecting the comfort of the wearer, cumulatively provides substantial savings when the filter masks are shipped.

The embodiment illustrated in FIGS. 5–7 is held on the wearer's head in substantially the same orientation as the embodiment illustrated in FIG. 1. That is, the reverse pleat 24 and lower moldable stiffener 22 cooperate to form a pocket-like shape to receive the chin and lower jaw and to provide a positive facial lock in the jaw and chin area. Upper moldable stiffener 20 provides a positive facial lock in the nose and cheek area. Furthermore, bound vertical edges 28 and 32 are held tightly against the cheeks so that a positive facial lock is provided around all of the outer edges of filter mask 40.

Figure 8:
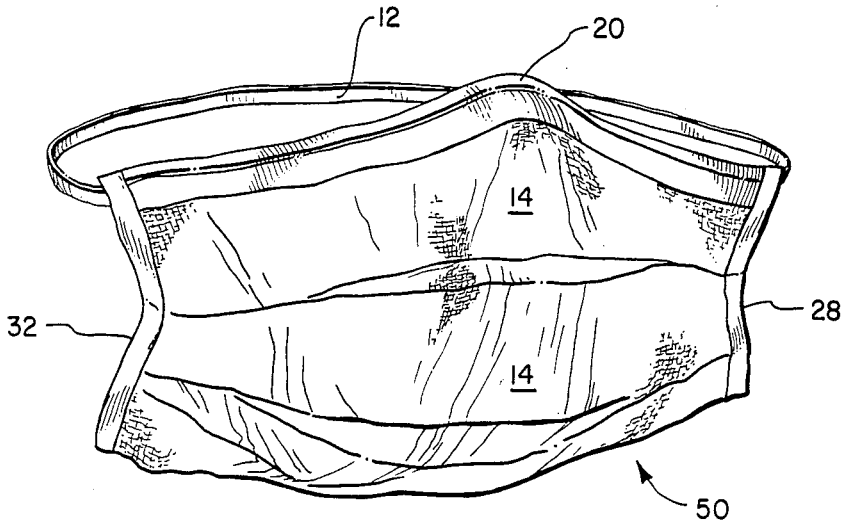
FIG. 8 is a perspective view of another presently preferred embodiment of the present invention in a configuration ready for installation on the face.
Figure 9:
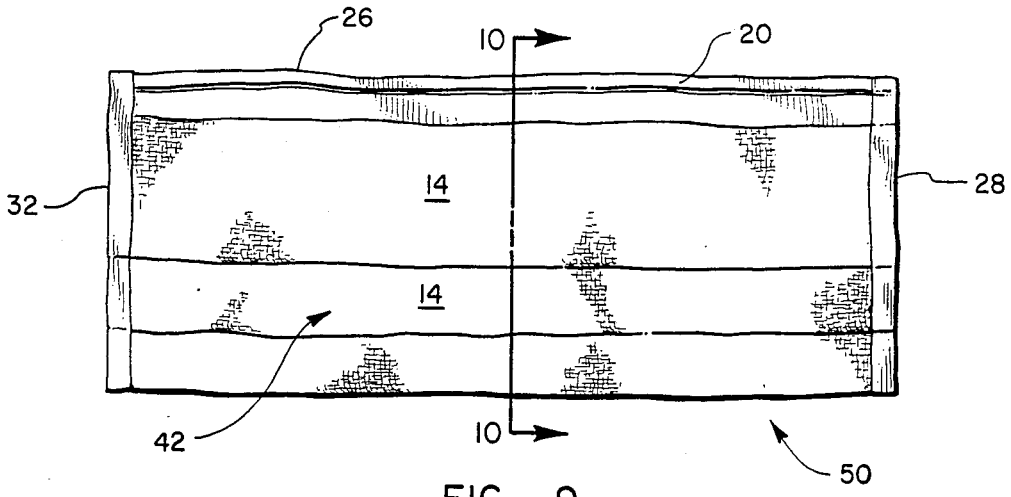
FIG. 9 is an elevated view showing the embodiment illustrated in FIG. 8 in a storage configuration taken from a direction facing toward the outer surface of the embodiment.
Figure 10:
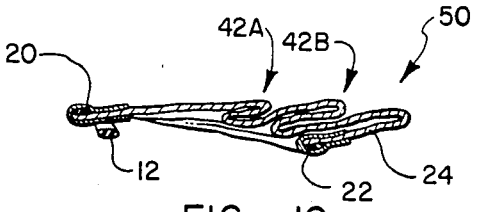
FIG. 10 is a cross-sectional view of the embodiment shown in FIG. 9 taken along line 10—10.

Another embodiment of the present invention is illustrated in FIGS. 8–10 and generally designated 50. FIG. 8 is a perspective view of what is termed the staggered pleat embodiment 50 of the present invention as it is configured when ready to be installed on the face. The staggered pleat embodiment 50, as with the omega pleat and duckbill pleat embodiments, 40 and 10, respectively, incoporates the essential features of the present invention. As can be seen in the cross-sectional view of FIG. 10, staggered pleat mask 50 includes upper and lower moldable stiffeners 20 and 22, reverse pleat 24, and bound vertical edges 28 and 32 as shown in FIG. 8. Furthermore, the staggered pleat embodiment shown in FIG. 8 utilizes a single elastic headband 12.

FIG. 9 is an elevated view, taken facing the outer surface of filter mask 50. The arrangement of the staggered pleats will now be described with particular reference to FIG. 10, the pleats being generally indicated at 42A and 42B. Reverse pleat 24 is essentially identical to reverse pleats 24 found in the other embodiments. hereinbefore described.

FIG. 10 shows in cross-section, along line 10—10 of FIG. 9, the pleating arrangement of the embodiment illustrated in FIGS. 8 and 9. In FIG. 10, two staggered pleats 42A and 42B are shown. However, in some circumstances it may be advantageous to include more than two staggered pleats in filter material 14. From FIG. 10, it can be seen that the pleats 42A and 42B are staggered side by side, that is, pleats 42A and 42B are not folded upon one another. As is the case with the previously described embodiments, the purpose of staggered pleats 42A and 42B is to provide expansion of filter material 14 into a cup-like cavity so that a space between the mouth and the inner surface of the filter material is formed.

The filter masks of the present invention hereinbefore described provide a mask which exhibits filtering efficiencies much greater than masks which have been hitherto available in the prior art. While the embodiments disclosed incorporate various pleating arrangements, the inclusion of a reverse pleat, moldable conforming bands, and properly bound edges of the filter material, provides a filter mask which is highly efficient and comfortable to wear for long periods of time. Most importantly, the structure of the filter mask prevents leakage of air around the edges of the mask and ensures a tight seal between the face and the mask.

The filter mask described herein has the further advantage of being easily placed upon the wearer's head, especially when an elastic headband, rather than a string tie, is used. Still further, the mask may be easily adjusted while it is worn on the face. Importantly in clean room applications, the mask, when constructed as disclosed herein, does not shed significant numbers of fibers or particles. Even further, the mask of the present invention is easily fabricated so as to fit a wide variety of face sizes. Still further, the mask weighs less, and may be more compactly stored, than those masks hitherto available in the prior art. Furthermore, by incorporating various pleating arrangements within the filter material, the mask may be made to maintain a space between the face and the inner surface of the filter material, thus, providing greater comfort for the wearer.

The invention herein claimed may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A filter mask comprising:

a filter medium having an inner surface to be worn against a wearer's face, and an outer surface, said filter medium comprising pleated means for folding and unfolding said filter medium such that when folded said filter medium assumes an essentially flat storage configuration having top, bottom and side edges and such that when unfolded said filter medium forms a mask adapted for placement on the wearer's head so as to cover the nose and mouth of the wearer, and said pleated means comprising reverse pleat means formed by folding said bottom edge of said filter medium towards said inner surface such that only a lower portion of each side edge is folded back upon itself and secured along said overlapping portion so as to provide a pocket formed at the lower end of said mask and adapted to fit over the chin of the wearer when unfolded; and means for securing said mask to the head of the wearer.

2. A filter mask as set forth in claim 1 further comprising first moldable stiffening means for conforming said filter medium to the nose and cheek area of the wearer's face, said first moldable stiffening means attached to said filter medium along a top portion thereof.

3. A filter mask as set forth in claim 2 further comprising second moldable stiffening means for conforming said filter medium to the chin and jaw area of the wearer's face, said second moldable stiffening means attached to said filter medium along a bottom portion thereof.

4. A filter mask as set forth in claim 2 wherein said pleated means is folded in a staggered pleat by creating immediately adjacent pleats in said sheet of filter material.

5. A filter mask as set forth in claim 2 wherein said pleated means is folded in an omega pleat by folding said filter material such that when disposed between the folded and unfolded configurations said filter material has an omega cross-sectional shape.

6. A filter mask as set forth in claim 2 wherein said pleated means is folded in a duckbill pleat by folding said filter medium such that an expandable flap of filter medium flexibly protrudes from said outer surface.

7. A filter mask as set forth in claim 3 wherein said mask comprises a vapor barrier means along said top portion for restricting the flow of vapor through said filter medium.

8. A filter mask as set forth in claim 1 wherein said means for securing said filter mask comprises a single elastic headband.

9. A pleated filter mask which, when folded, assumes an essentially flat storage configuration and which when unfolded, assumes an installed configuration for covering the nostrils and mouth of a wearer, comprising:

flexible filtering means for filtering inhaled and exhaled air comprising:

an inner surface to be worn against the wearer's face, an outer surface, essentially parallel top and bottom edges and essentially parallel side edges; and a reverse pleat formed by folding said bottom edge towards said inner surface such that said top and bottom edges remain essentially parallel and said side edges are each folded back upon themselves and secured only along a lower portion of the length thereof near the bottom of said side edges, whereby when unfolded said reverse pleat forms a pocket at the lower end of said mask into which the chin of the wearer is fitted;

first moldable stiffening means for conforming said filtering means to the wearer's head attached to said filtering means along said top edge, said first moldable stiffening means being laterally disposed across the wearer's nose when the filter mask is installed upon the wearer's head; and means for securing said mask to the wearer's head.

10. A filter mask as set forth in claim 9 further comprising second moldable stiffening means for conforming said filtering means to the wearer's head attached to said filtering means along said bottom edge, said second moldable stiffening means being laterally disposed under the wearer's chin when the filter mask is installed upon the wearer's head.

11. A filter mask as set forth in claim 10 wherein said first and said second moldable stiffening means comprise encapsulated moldable aluminum stiffener strips.

12. A filter mask as set forth in claim 10 wherein said first and said second moldable stiffening means extend completely along the width of said top edge and said bottom edge, respectively.

13. A filter mask as set forth in claim 9 wherein said flexible filtering means comprises a rectangular sheet of filtering material.

14. A filter mask as set forth in claim 9 wherein said flexible filtering means has a bacterial filtration efficiency greater than 90%.

15. A filter mask as set forth in claim 9 wherein said inner surface comprises a material suitable for nonirritating contact with a human face.

16. A filter mask as set forth in claim 9 wherein said outer surface comprises a material which is substantially stiffer than the material comprising said inner surface.

17. A filter mask as set forth in claim 9 wherein said flexible filtering means comprises a sheet of filtering material, said filtering material comprising:

a first layer of nonirritating material a second middle layer of a material having a high filtration efficiency; and a third layer providing stiffness to the filtering material.

18. A filter mask as set forth in claim 9 wherein said flexible filtering means is folded in a staggered pleat by creating immediately adjacent pleats in said filtering means.

19. A filter mask as set forth in claim 9 wherein said flexible filtering means is folded in an omega pleat by folding said filtering means such that when disposed between the storage and installation configuration said filter material has an omega cross-sectional shape.

20. A filter mask as set forth in claim 9 wherein said flexible filtering means is folded in a duckbill pleat by folding said filtering means such that an expandable flap of filter material flexibly protrudes from said outer surface.

21. A filter mask as set forth in claim 20 wherein said protruding portion of said duckbill pleat is provided with a stiffener portion.

22. A filter mask as set forth in claim 9 wherein said mask has four peripheral edges and said four peripheral edges are bound by heat activated tape.

23. A filter mask as set forth in claim 22 wherein said vapor barrier comprises heat activated tape.

24. A filter mask as set forth in claim 9 further comprising a vapor barrier formed along an upper edge of said mask.

25. A filter mask as set forth in claim 9 wherein said reverse pleat comprises a fold provided on said flexible filtering means such that between about ½ inch and 1½ inches of a bottom portion of said flexible filtering means is folded upon its inner surface and the edges adjacent to said bottom portion are bound together to form a pocket-like recess.

26. A filter mask as set forth in claim 9 wherein said means for securing said mask comprises string ties, each of said string ties being attached to said mask at a point along said top edge.

27. A filter mask as set forth in claim 9 wherein said means for securing said mask comprises a single elastic headband, said elastic headband having two ends, each of said ends being attached to said top edge of the mask.

28. A filter mask as set forth in claim 9 wherein said means for securing said mask comprises a single elastic headband, said elastic headband attached in proximity to said top edge of said filtering means.

29. A filter mask as set forth in claim 9 wherein said mask has four peripheral edges and all of said peripheral edges are bound.

30. A filter mask as set forth in claim 9 wherein said mask is substantially flat when in a storage configuration.

31. A filter mask as set forth in claim 9 wherein said mask forms a cup-like shape when in an installed configuration.

32. A pleated filter mask for isolating the mouth and nostrils of a wearer from the surrounding environment, said filter mask having both a folded storage configuration and an unfolded installed configuration, comprising:

a flexible filtering medium having top, bottom and two side edges, said filtering medium being folded so as to form a reverse pleat wherein said bottom edge is essentially parallel to said top edge, and said side edges are each folded back upon themselves and secured only along a bottom portion of the length thereof so as to form a pocket-like recess at the lower end of said mask when said mask is in the installed configuration, said pocket-like recess receiving the chin of the wearer when installed on the face of the wearer;

a first moldable stiffener attached to said filtering medium along the length of said bottom edge, said first moldable stiffener being capable of conforming said bottom edge to the shape of the wearer's chin;

a second moldable stiffener attached along the length of said top edge, said second moldable stiffener being capable of conforming said top edge to the shape of the wearer's nose and cheeks, said second moldable stiffener being substantially parallel to said first moldable stiffener when said mask is in the storage configuration; and means for holding said mask in position on the wearer's head such that a positive facial lock is created.

33. A filter mask as set forth in claim 32 wherein said flexible filtering medium comprises a three layer filter material.

34. A filter mask as set forth in claim 32 wherein said flexible filtering medium comprises an inner surface and an outer surface, said inner surface comprising a material suitable for nonirritating contact with a human face and said outer surface comprises a material which is stiffer than the material comprising said inner surface.

35. A filter mask as set forth in claim 32 wherein said flexible filtering medium comprises a sheet of filtering material, said filtering material comprising:

a first layer of nonirritating material;

a second middle layer of a material having a high filtration efficiency; and a third layer providing stiffness to the filtering material.

36. A filter mask as set forth in claim 32 wherein said flexible filtering medium is folded in a staggered pleat.

37. A filter mask as set forth in claim 32 wherein said flexible filtering medium is folded in an omega pleat.

38. A filter mask as set forth in claim 32 wherein said flexible filtering medium is folded in a duckbill pleat.

39. A filter mask as set forth in claim 32 wherein said reverse pleat comprises a fold provided on said flexible filtering medium such that between about ½ inch and about 1½ inches of said flexible filtering medium is folded upon its inner surface and bound together along said side edges.

40. A filter mask as set forth in claim 32 wherein said flexible filtering medium comprises a rectangular sheet of filter medium and wherein said first and said second moldable stiffeners comprise moldable aluminum stiffeners.

41. A filter mask as set forth in claim 32 further comprising a vapor barrier formed at said top edge of said mask, said vapor barrier being formed by applying heat activated tape to said filtering medium.

42. A filter mask as set forth in claim 32 wherein said means for holding said filter mask comprises a single headband, said headband having two ends, each of said ends being connected to said top edge of said filtering medium.

43. A filter mask as set forth in claim 32 wherein said mask is substantially flat when in the storage configuration.

44. A filter mask as set forth in claim 32 wherein said mask forms a cup-like shape when in the installed configuration.

45. A pleated filter mask which, when folded, assumes an essentially flat storage configuration and which, when unfolded, assumes an installed configuration for covering the nostrils and mouth of a wearer, comprising:

a flexible filtering medium comprising:

a top portion, a bottom portion, and two side edges; an inner surface to be worn against the wearer's face and an outer surface;

a reverse pleat formed by folding the bottom portion and lower portions of said side edges towards said inner surface and securing said side edges along said lower portions thereof so as to provide a single pocket-like recess on a portion of the bottom half of said mask, said recess being capable of fitting over the chin of the wearer; and a duckbill pleat, said duckbill pleat being formed by providing an expandable pouch-like flap of filtering medium protruding from the outer surface of said filtering medium;

a first moldable stiffener attached to said filtering medium along the bottom portion, said first moldable stiffener being laterally disposed under the wearer's chin when the mask is installed upon the wearer's head;

a second moldable stiffener attached to said filtering medium along said top portion, said second moldable stiffener being laterally disposed across the wearer's nose when the mask is installed upon the wearer's head; and a headband for securing said mask to the wearer's head.

46. A pleated filter mask for filtering the air inhaled and exhaled from the mouth and nostrils of the wearer, said filter mask having both an expanded and unfolded installed configuration and a flat, folded storage configuration comprising:

a sheet of filter material having an inner and an outer surface and top, bottom and two side edges, said bottom edge being folded such that a lower portion of said inner surface is folded upon itself and said side edges are overlapping and secured along lower segments thereof adjacent said lower portion so as to form a single reverse pleat on a portion of the lower half of said mask;

a first moldable stiffener encapsulated within binding material, said binding material being secured to said filter material along substantially the entire length of said top edge so as to form a vapor barrier, said first moldable stiffener being capable of conforming said filter material to the shape fo the wearer's nose and cheeks;

a second moldable stiffener secured to said filter material in proximity to, and along substantially the entire length of, said bottom edge of said filter material, said second moldable stiffener being capable of conforming the shape of said filter material to the wearer's chin and jaw; and a single headband attached to said filter material in proximity to the ends of said first moldable stiffener, said headband being capable of partially encircling the wearer's head and thereby holding the unfolded mask installed on the wearer's face.

* * * * *

UNITED STATES PATENT AND TRADEMARK OFFICE

CERTIFICATE OF CORRECTION

PATENT NO. : 4,688,566

DATED : August 25, 1987

INVENTOR(S) : Elvin L. Boyce

It is certified that error appears in the above-identified patent and that said Letters Patent is hereby corrected as shown below:

Column 4, line 36, "breaths" should be --breathes--
Column 4, line 67,"light weight" should be --lightweight--
Column 5, lines 42-43, "wherein in" should be --wherein--
Column 6, line 1, "filter mask" should be --filter masks--
Column 7, line 43, "illustration" should be --illustrated--
Column 7, line 62, "stiffners" should be --stiffeners--
Column 8, line 7, "cheeck" should be --cheek--
Column 8, line 15, "stiffners" should be --stiffeners--
Column 8, line 24, "stiffners" should be --stiffeners--
Column 8, line 58, "fiber" should be --fibers--
Column 18, line 45, "fo the" should be --of the--

Signed and Sealed this

Sixteenth Day of February, 1988

*Attest:*

*Attesting Officer*

DONALD J. QUIGG

*Commissioner of Patents and Trademarks*